US010954829B2

(12) United States Patent
Blackmur et al.

(10) Patent No.: US 10,954,829 B2
(45) Date of Patent: Mar. 23, 2021

(54) OLDHAM FLEXPLATE FOR CONCENTRIC CAMSHAFTS CONTROLLED BY VARIABLE CAMSHAFT TIMING

(71) Applicant: BorgWarner, Inc., Auburn Hills, MI (US)

(72) Inventors: Shawn Blackmur, Brooktondale, NY (US); Chad McCloy, Cortland, NY (US)

(73) Assignee: BORGWARNER, INC., Auburn Hills, MI (US)

( * ) Notice: Subject to any disclaimer, the term of this patent is extended or adjusted under 35 U.S.C. 154(b) by 0 days.

(21) Appl. No.: 16/719,580

(22) Filed: Dec. 18, 2019

(65) Prior Publication Data

US 2020/0200052 A1 Jun. 25, 2020

Related U.S. Application Data

(60) Provisional application No. 62/781,895, filed on Dec. 19, 2018.

(51) Int. Cl.
*F01L 1/34* (2006.01)
*F01L 1/344* (2006.01)

(52) U.S. Cl.
CPC ..... *F01L 1/3442* (2013.01); *F01L 1/34413* (2013.01); *F01L 2001/34423* (2013.01); *F01L 2001/34483* (2013.01); *F01L 2001/34496* (2013.01); *F01L 2201/00* (2013.01)

(58) Field of Classification Search
CPC . F01L 1/3442; F01L 1/34413; F01L 1/34409; F01L 1/352; F01L 2001/34496; F01L 2001/34423; F01L 2001/34483; F01L 2001/0476; F01L 2001/34469; F01L 2001/0473; F01L 2250/02; F01L 2201/00; F01L 2820/032
See application file for complete search history.

(56) References Cited

U.S. PATENT DOCUMENTS

| | | | |
|---|---|---|---|
| 5,417,186 | A | 5/1995 | Elrod et al. |
| 6,044,816 | A | 4/2000 | Buck et al. |
| 6,253,719 | B1 | 7/2001 | Methley |
| 7,536,986 | B2 | 5/2009 | Schneider |
| 7,866,293 | B2 | 1/2011 | Clever et al. |
| 7,938,090 | B2 | 5/2011 | Lancefield et al. |
| 8,113,159 | B2 | 2/2012 | Myers et al. |

(Continued)

FOREIGN PATENT DOCUMENTS

| | | | |
|---|---|---|---|
| EP | 3141711 | A1 | 3/2017 |
| GB | 2401163 | A | 11/2004 |

*Primary Examiner* — Zelalem Eshete
(74) *Attorney, Agent, or Firm* — Reising Ethington P.C.

(57) ABSTRACT

A variable camshaft timing (VCT) assembly for changing the angular position of concentric camshafts relative to a crankshaft includes a coupling plate having a first plurality of Oldham features configured to engage a first plurality of Oldham receiving features carried by a first VCT device and a second plurality of Oldham features configured to engage a second plurality of Oldham receiving features carried by a second VCT device; the coupling plate is positioned axially between the first VCT device and the second VCT device permitting the first VCT device and the second VCT device to move radially outwardly and inwardly relative to an axis of camshaft rotation.

19 Claims, 9 Drawing Sheets

(56) References Cited

U.S. PATENT DOCUMENTS

| | | | | |
|---|---|---|---|---|
| 8,122,863 | B2 | 2/2012 | Myers | |
| 8,146,551 | B2 | 4/2012 | Pluta | |
| 8,191,521 | B2 | 6/2012 | Kandolf et al. | |
| 8,256,393 | B2 | 9/2012 | Simpson et al. | |
| 8,261,705 | B2 | 9/2012 | Lancefield et al. | |
| 8,336,512 | B2 | 12/2012 | Myers et al. | |
| 8,375,906 | B2 | 2/2013 | Myers et al. | |
| 8,522,737 | B2 | 9/2013 | Yokoyama et al. | |
| 8,596,236 | B2 | 12/2013 | Chung et al. | |
| 8,677,960 | B2 | 3/2014 | Knecht et al. | |
| 8,695,545 | B2 | 4/2014 | Tateno | |
| 8,978,605 | B2 | 3/2015 | Friedrichs | |
| 9,297,281 | B2 | 3/2016 | Sisson et al. | |
| 9,297,283 | B2 | 3/2016 | Schafer et al. | |
| 9,366,159 | B2 | 6/2016 | Wigsten et al. | |
| 9,506,379 | B2 | 11/2016 | Dupuis | |
| 9,512,747 | B2 | 12/2016 | Kim | |
| 9,638,306 | B2 | 5/2017 | Schafer et al. | |
| 9,797,277 | B2 | 10/2017 | Chung et al. | |
| 9,840,942 | B2 | 12/2017 | Zwahr et al. | |
| 2005/0051121 | A1 | 3/2005 | Smith | |
| 2005/0056249 | A1 | 3/2005 | Heinze et al. | |
| 2008/0196681 | A1 | 8/2008 | Lancefield et al. | |
| 2013/0092114 | A1 | 4/2013 | Pietsch et al. | |
| 2014/0190434 | A1 | 7/2014 | Bayrakdar | |
| 2015/0040716 | A1* | 2/2015 | Kandolf ..... | F01L 1/3442 74/568 R |
| 2015/0068474 | A1 | 3/2015 | Kim et al. | |
| 2017/0254232 | A1 | 9/2017 | Stays | |

* cited by examiner

OLDHAM FLEXPLATE FOR CONCENTRIC CAMSHAFTS CONTROLLED BY VARIABLE CAMSHAFT TIMING

CROSS-REFERENCE TO RELATED PATENT APPLICATIONS

This patent application claims the benefit of priority from U.S. Provisional patent application No. 62/781,895 filed on Dec. 19, 2019, the entire contents of which are hereby incorporated by reference.

TECHNICAL FIELD

The present application relates to variable camshaft timing (VCT) and, more particularly, to concentric camshafts that are angularly adjusted using VCT.

BACKGROUND

Internal combustion engines (ICEs) include camshafts that are driven by a crankshaft according to a particular angular relationship with the crankshaft to open and close valves that regulate the combustion process.

Typically, an endless loop or one or more mechanical gears engages both the crankshaft and the camshaft(s) of the ICE to maintain a fixed relationship between the angular position of the crankshaft and the angular position of the camshaft(s). However, modern engines often incorporate a variable camshaft timing (VCT) device that selectively changes the angular position of the camshafts) relative to the crankshaft. That is, the VCT device can change the relative angular positions (sometimes referred to as phase) of camshafts relative to the crankshaft.

The camshafts used by ICEs can be configured in many different ways. Some ICEs use a single camshaft while others use multiple camshafts. And with, respect to multiple camshafts, an ICE can use separate, discrete camshafts one of which operates intake valves and another of which, operates exhaust valves. In contrast, some ICEs use two, concentrically-positioned camshafts: an inner camshaft can operate one of the intake or exhaust valves while an outer camshaft can operate the other of the intake or exhaust valves. An assembly of concentrically-arranged camshafts can use a first VCT device to angularly adjust one of the camshafts and a second VCT device to angularly adjust the other camshaft. The inner camshaft and outer camshaft can be angularly displaced relative to each other. But concentric camshaft assemblies inherently include some clearances between the inner camshaft and the outer camshaft that can cause binding when the camshafts are misaligned. Then, the VCT devices may no longer be able to angularly displace the inner camshaft with respect to the outer camshaft.

SUMMARY

In one implementation, variable camshaft, timing (VCT) assembly for changing the angular position of concentric camshafts relative to a crankshaft includes a coupling plate having a first plurality of Oldham features configured to engage a first plurality of Oldham receiving features carried by a first VCT device and a second plurality of Oldham features configured to engage a second plurality of Oldham receiving features carried by a second VCT device; the coupling plate is positioned axially between the first VCT device and the second VCT device permitting the first VCT device and the second VCT device to move radially outwardly and inwardly relative to an axis of camshaft rotation.

In another implementation, a VCT assembly for changing an angular position of concentric camshafts relative to a crankshaft includes a first VCT device, having a first plurality of Oldham receiving features, configured to rigidly couple with a first concentric camshaft; a second VCT device, having a second plurality of Oldham receiving features, configured to rigidly couple with a second concentric camshaft; and a coupling plate, including a first plurality of Oldham features that engage the first plurality of Oldham receiving features and a second plurality of Oldham features that engage the second, plurality of Oldham receiving features, positioned axially between the first VCT device and the second VCT device, wherein the first VCT device and the second VCT device move radially outwardly and inwardly relative to an axis of camshaft rotation.

In yet another implementation, a VCT assembly for changing an angular position of concentric camshafts relative to a crankshaft includes a first VCT device, having a first plurality of Oldham receiving features that extend radially-outwardly away from an axis of camshaft rotation, configured to rigidly couple with a first concentric camshaft; a second VCT device, having a second plurality of Oldham receiving features that extend at least partially in a direction parallel to the axis of camshaft rotation, configured to rigidly couple with a second concentric camshaft; and a coupling plate, including a first plurality of Oldham features formed in an inner diameter that engage the first plurality of Oldham receiving features and a second plurality of Oldham features formed in an outer diameter that, engage the second plurality of Oldham receiving features, positioned axially between the first VCT device and the second VCT device, wherein the first VCT device and the second VCT device move radially outwardly and inwardly relative to an axis of camshaft rotation.

DETAILED DESCRIPTION

A variable camshaft timing (VCT) assembly used with concentric camshafts includes a first VCT device that changes the angular position of a first concentric camshaft relative to a crankshaft and a second VCT device that changes the angular position of a second concentric camshaft relative, to the crankshaft. The first VCT device can be coupled to an inner camshaft and the second VCT device can be coupled to an outer camshaft. The first VCT device and the second VCT device may be coupled to each other through a coupling plate that includes Oldham features permitting the radial misalignment of the inner camshaft relative to the outer camshaft as well as the radial misalignment of the first VCT device relative to the second. VCT device. Manufacturing tolerances may exist that permit some clearance between the inner camshaft and the outer camshaft. The clearance or space created due to manufacturing tolerances can permit radial displacement of the inner camshaft relative to the outer camshaft. These clearances may also permit the angular displacement or tilting of the inner camshaft relative to the outer camshaft. The Oldham features of the coupling plate can be positioned axially between the first VCT device and the second VCT device. The Oldham features can be positioned in different locations depending on the embodiment In one embodiment, the Oldham features can be formed in an inner diameter and an outer diameter of a coupling plate. In another embodiment, the Oldham features can be formed on opposite axially-facing surfaces; the Oldham features on one side can be spaced 180 degrees from each other while the Oldham features on the other side can also be 180 degrees apart from each other. The Oldham features on one side of the coupling plate can be offset by 90 degrees from the Oldham features on the other side of the coupling plate. The Oldham features can permit radial movement of the inner camshaft relative to the outer camshaft while preventing binding of one concentric camshaft to another. VCT devices, which can sometimes be referred to as camshaft phasers, may be implemented using hydraulically-actuated VCT devices or electrically-actuated VCT devices. The VCT assembly using the Oldham plate can include two hydraulically-actuated VCT devices, two electrically-actuated VCT devices, or one hydraulically-actuated VCT device and one electrically-actuated VCT device.

Figure 1:
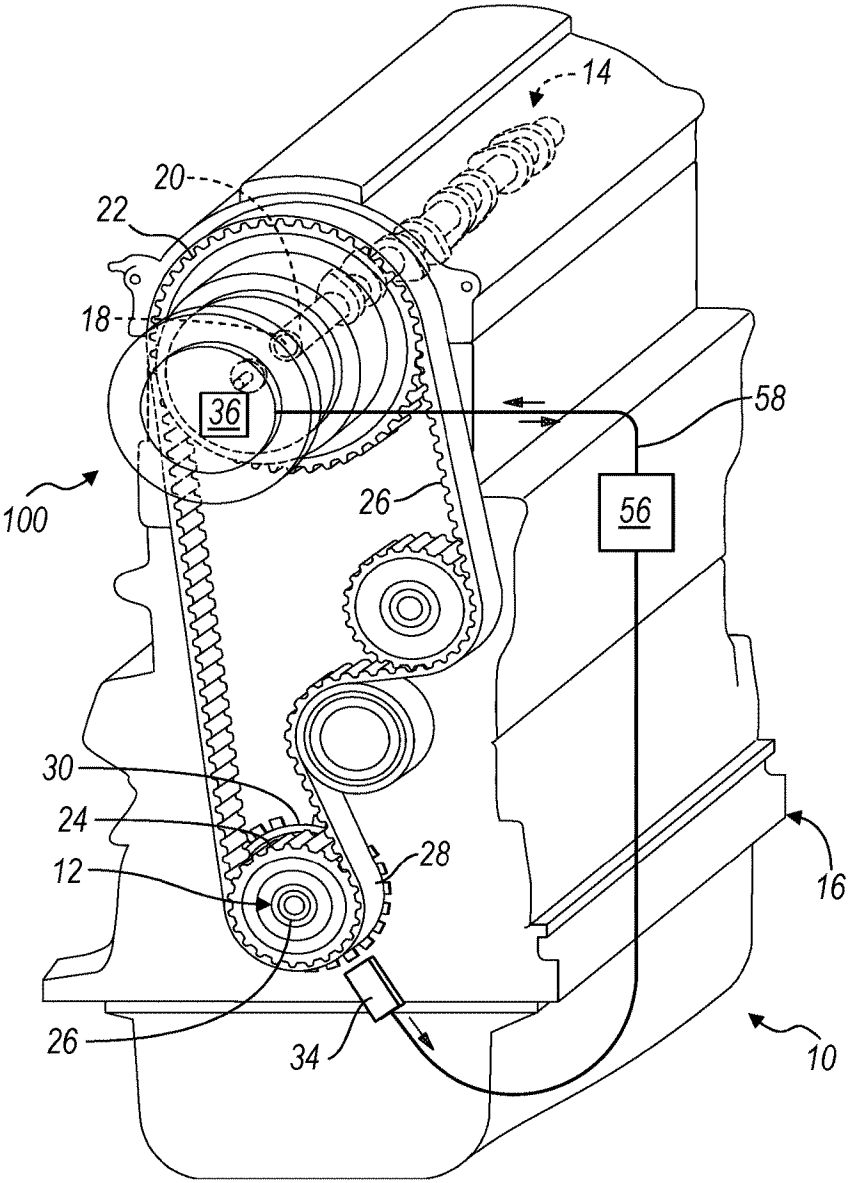
FIG. 1 is a perspective view depicting an implementation of a variable camshaft timing (VCT) assembly with an internal combustion engine (ICE)
Figure 2:
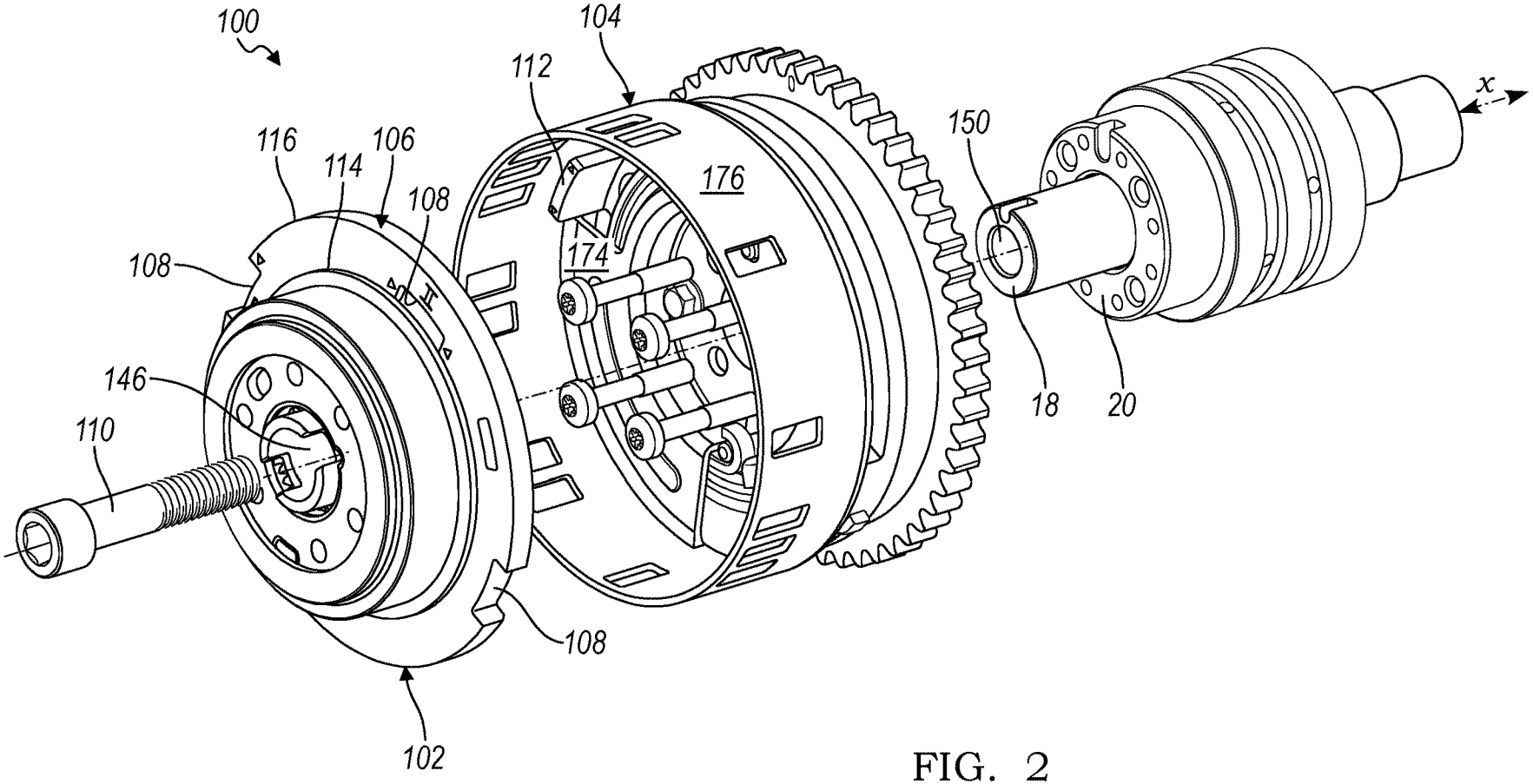
FIG. 2 is an isometric partially-exploded view depicting an implementation of a VCT assembly.
Figure 3:
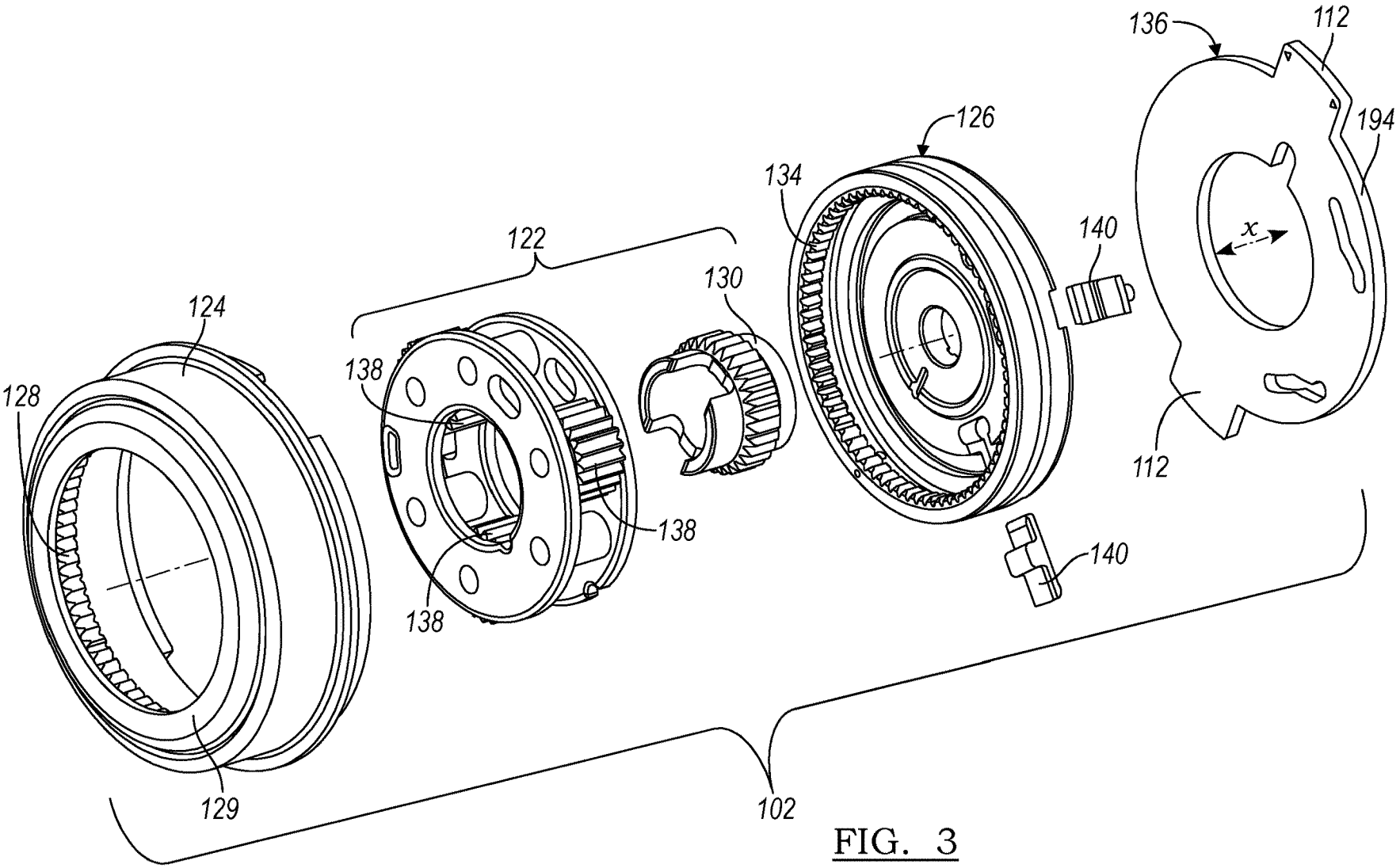
FIG. 3 is an isometric exploded view depicting a portion of a VCT assembly.
Figure 4:
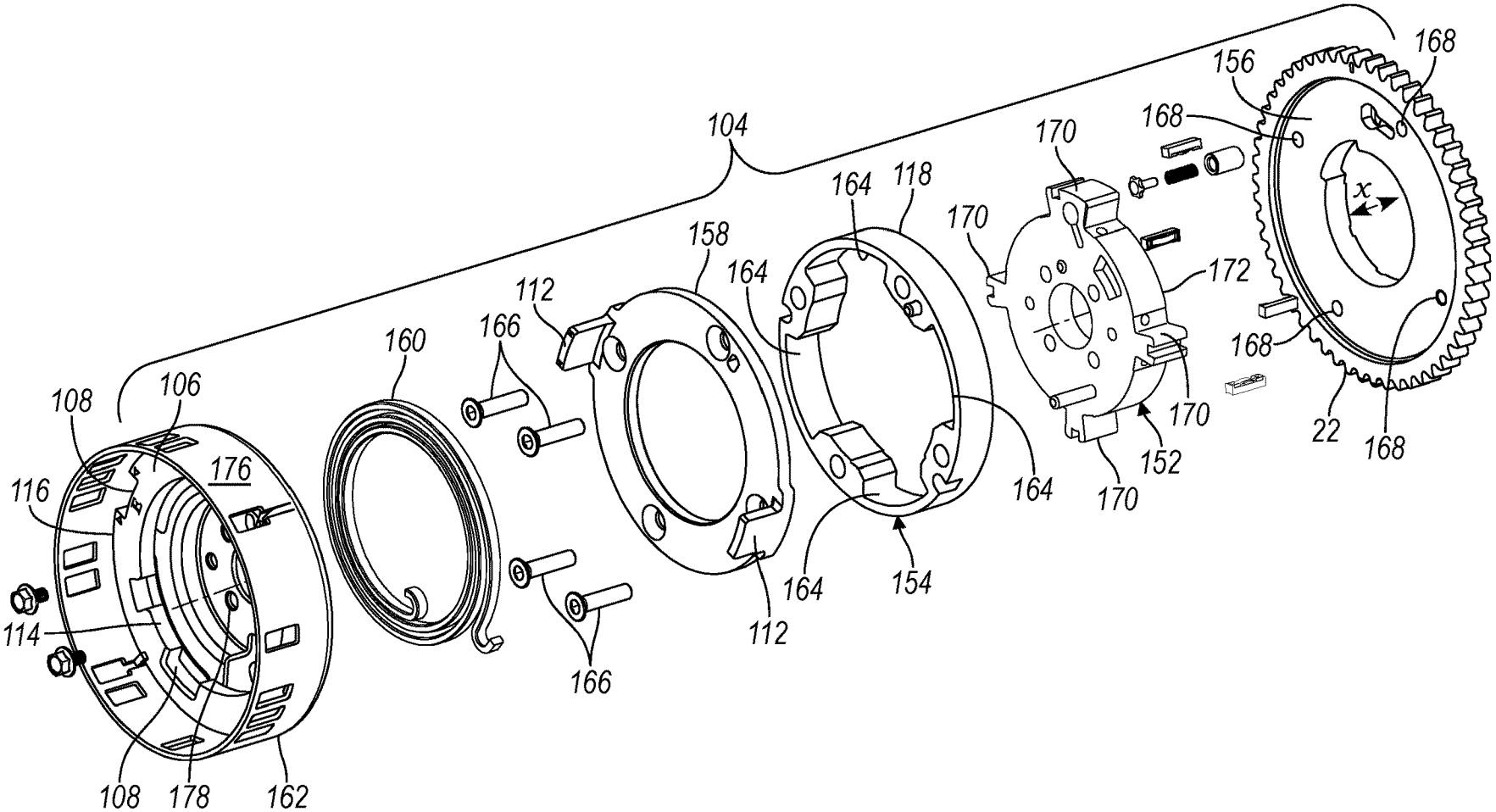
FIG. 4 is an isometric exploded view depicting another portion of a VCT assembly.
Figure 5:
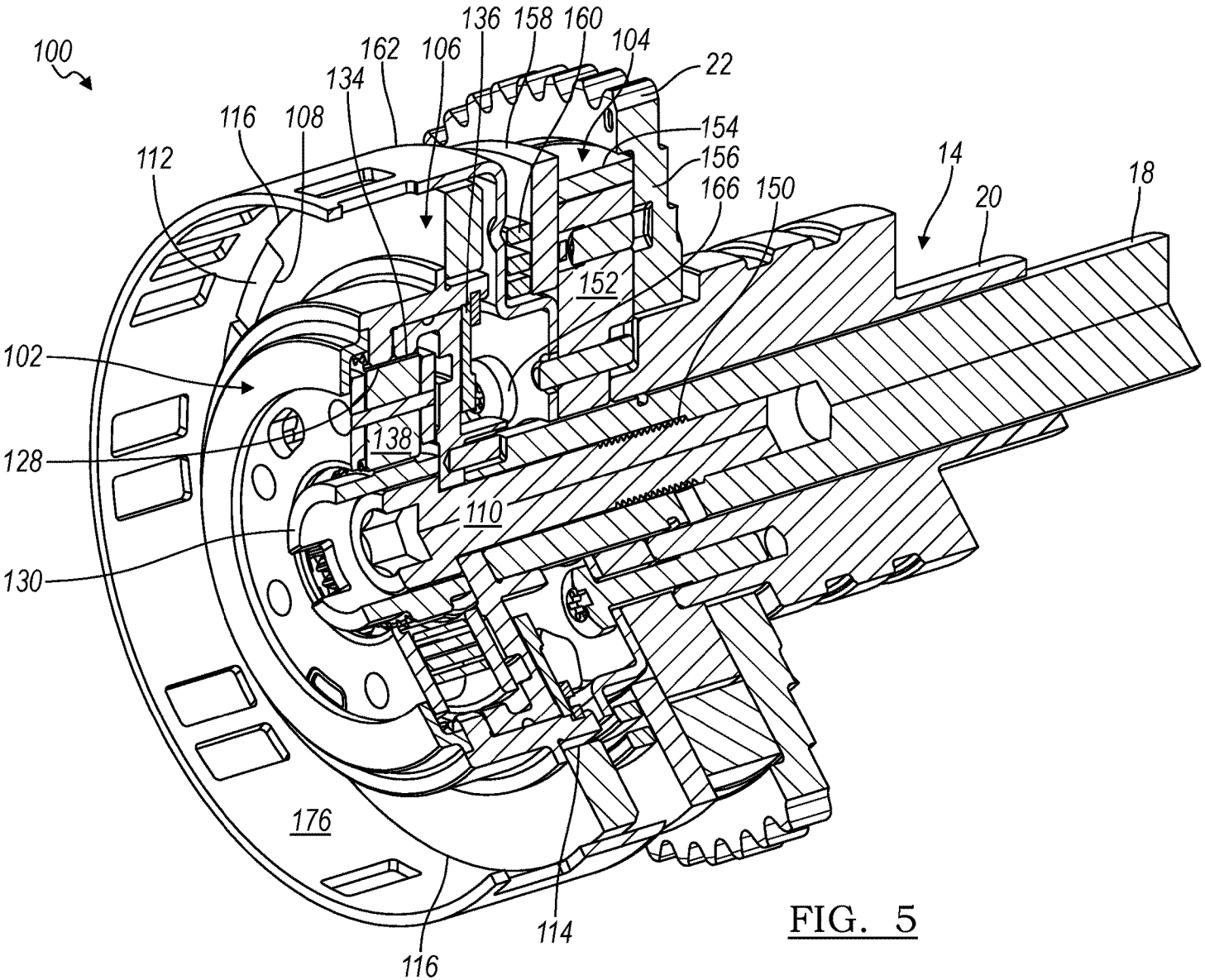
FIG. 5 is an isometric cross-sectional view depicting a VCT assembly.

Turning to FIG. 1, an embodiment of a system 10 is shown in which a VCT assembly 100 used with concentric camshafts can be implemented. The system 10 includes electronic hardware that monitors the angular movement of a crankshaft 12 and the concentric camshafts) 14 of an internal combustion engine 16. The angular movement of the crankshaft 12 and camshaft(s) 14 relative to each other can be used to generate electrical signals directing a motor controller or a hydraulic valve to advance, retard, or maintain the phase relationship between the crankshaft 12 and the camshafts 14 via first and second VCT devices, which can also be referred to as a camshaft phasers. The internal combustion engine 12 includes the crankshaft 12, an inner camshaft 18, and an outer camshaft 20. A cam sprocket 22 can be attached to the assembly 100 of the first VCT device and the second VCT device. The VCT assembly 100 can be mechanically driven by a crank sprocket 24 linked to a nose 26 of the crankshaft 12 via the can sprocket 22. As the crankshaft 14 rotates, a driven member 28, such as a chain or one or more gears, drives the VCT assembly 10 by translating rotational movement of the crankshaft 12 into rotational movement of the VCT assembly 10. The crank sprocket 24 includes half as many teeth as the cam sprocket such that two 360 degree rotations of the crankshaft 12 results in one 360 degree rotation of the VCT assembly 100. The rotational movement of the crankshaft 12 can occur in response to a starter motor selectively engaging a flywheel during startup cranking or in response to piston movement during engine operation.

The crankshaft 12 includes a crank wheel 30 that can be used to identify the angular position and/or the angular velocity of the crankshaft 12. The crank wheel 30 is mounted to the nose 26 of the crankshaft 12 adjacent to the crank sprocket 24 and can be implemented as a 60-2 crank wheel. This means that the crank wheel 30 includes fifty eight evenly-spaced teeth around the circumference of the wheel 30 and a space along the circumference where two teeth have purposefully been omitted. This space is also called a crank index that identifies a defined point of crankshaft rotation relative to combustion, such as top-dead center (TDC). While this embodiment is described with regard to the 60-2 crank wheel, it should be appreciated that crank wheels having different numbers of teeth and index sizes could be used instead with equal success.

As the crank wheel 30 rotates with the crankshaft 12, a crank position sensor 34 located in close proximity to the teeth on the crank wheel 30 generates a signal that indicates an absence or presence of the teeth on the crank wheel 30. The crank position sensor 34 can be implemented as a hall-effect sensor that generates a high-voltage level when a tooth passes the sensor 34 and a low-voltage level when the index passes the sensor 34 or when the sensor 34 is located in between teeth on the crank wheel 30. The output from the crank position sensor 34 can be sent to a microcontroller that implements a variety of computing processes, including but not limited to the device controller disclosed herein. This will be discussed in more detail below. In response to an index on the crank wheel 30 that has eliminated teeth from a regularly spaced pattern, the microcontroller(s) may recognize the change and provide a signal in place of the missing signals. If the microcontroller is counting crank pulses, then the microcontroller may instead add the missing teeth to the count after passing and recognizing the index location.

Figures 6, 7, 8:
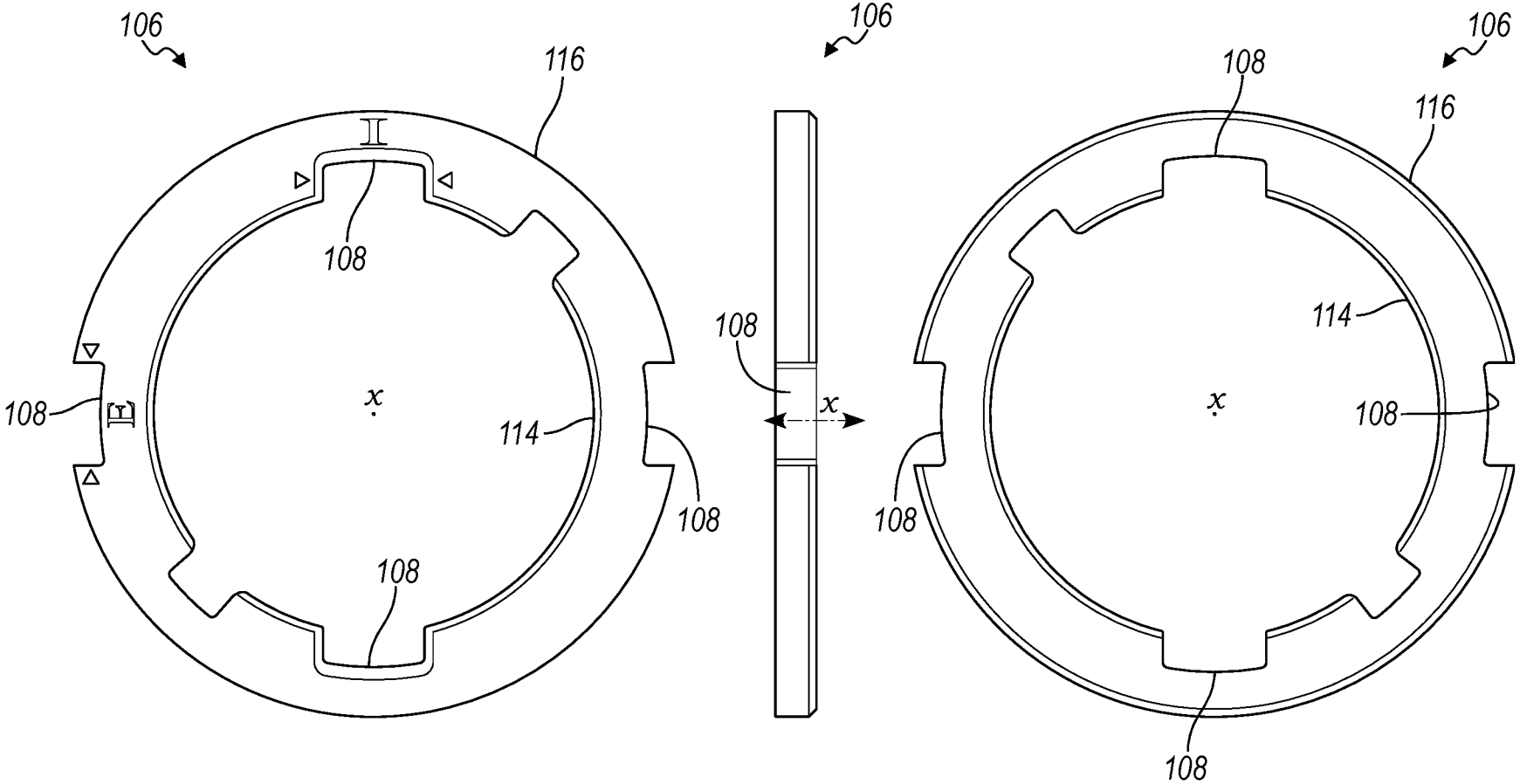
FIG. 6 is a profile view of an implementation of a coupling plate used in a VCT assembly.
FIG. 7 is another profile view of an implementation of a coupling plate used in a VCT assembly.
FIG. 8 is another profile view of an implementation of a coupling plate used in a VCT assembly.
Figure 9:
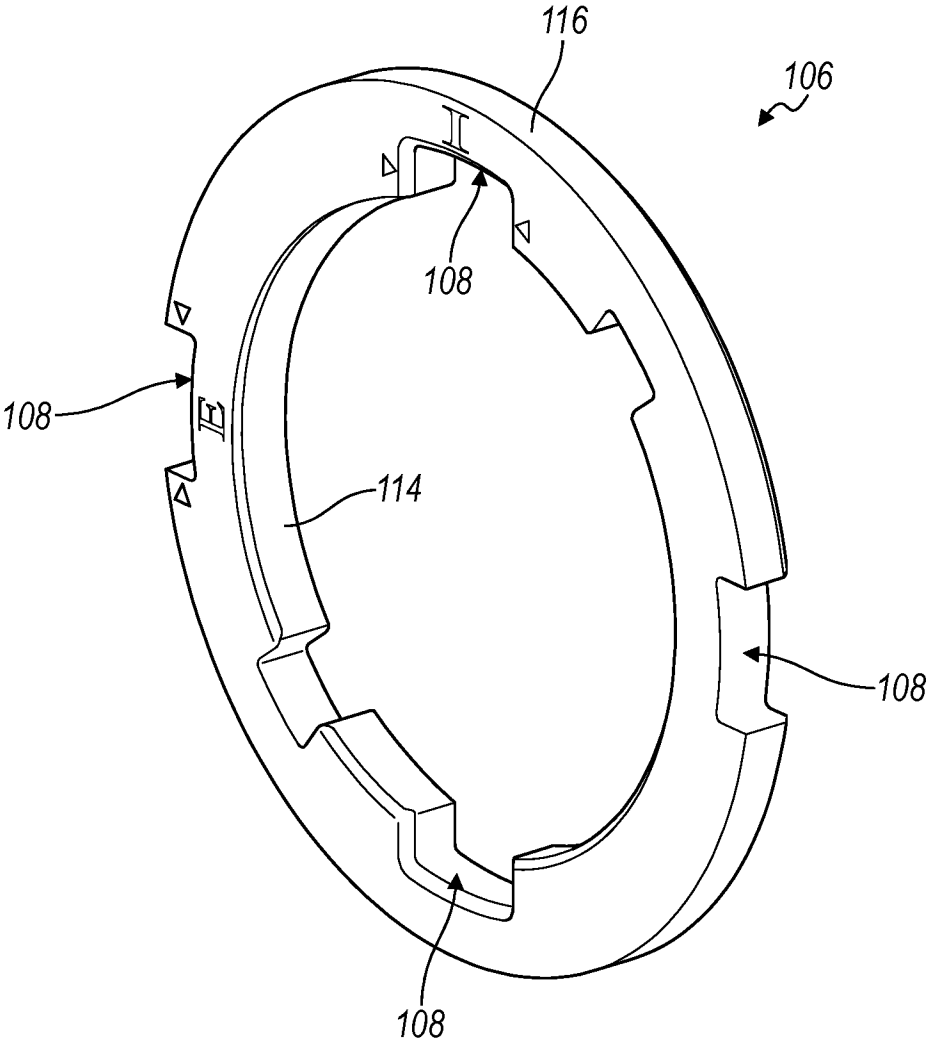
FIG. 9 is an isometric view of an implementation of a coupling plate used in a VCT assembly.

Turning to FIGS. 2-5, an implementation of a VCT assembly 100 used with concentric camshafts is shown. In this implementation, the VCT assembly 100 includes a first VCT device 102 that can be coupled to an inner camshaft 18 to control the angular position of the inner camshaft 18 relative to the angular position of the crankshaft 12 as well as a second VCT device 104 that can be coupled to an outer camshaft 20 and control the angular position of the outer camshaft 20 relative to the angular position of the crankshaft 12. A coupling plate 106 having Oldham features 108 is positioned, axially between the first VCT device 102 and the second VCT device 104 relative to an axis (x) of camshaft rotation. The coupling plate 106 in this implementation is shown in more detail by FIGS. 6-7. Oldham features 108 on an inner diameter 114 of the coupling plate 106 slidably engage the first VCT device 102 while Oldham features 108 on an outer diameter 116 of the coupling plate 106 slidably engage the second VCT device 104. The Oldham features 108 on the inner diameter 114 of the coupling plate 106 are positioned ninety degrees relative to Oldham features 108 on the outer diameter 116 of the coupling plate 106. In the embodiment of FIGS. 6-7, the Oldham features 108 are presented as recesses residing in the coupling plate 106 at the inner and outer diameters 114,116; in other embodiments the Oldham features 108 could be axially-extending and/or radially-extending projections.

The second VCT device 104 can be positioned nearest the concentric camshafts as measured along the axis of camshaft rotation (x) so that the output of the second VCT device 104 abuts the outer camshaft 20. The coupling plate 106 can be axially positioned between the first VCT device 102 and the second VCT device 104 such that a central bolt 110 can engage the inner camshaft 18 and capture the coupling plate 106 between the first VCT device 102 and the second VCT device 104. The Oldham features 108 on the inner diameter 114 of the coupling plate 106 can engage corresponding Oldham receiving features 112 on the first VCT device 102 and the Oldham features 108 on the outer diameter 116 of coupling plate 106 can engage corresponding Oldham features 112 on the second VCT device 104. In the embodiment of FIGS. 2-5, the Oldham receiving features 112 are presented as radially-extending projections (first VCT device 102) and axially-extending projections (second VCT device 104). Here, the recesses of FIGS. 6-7 accept reception of the projections. Still, in other embodiments, the Oldham receiving features 112 could be recesses residing in plates or other components of the first and second VCT devices 102, 104. The central bolt 110 can be torqued so that the first VCT device 102 and second VCT device 104 are not immovably coupled relative to each other but rather the first VCT device 102 and the second VCT device 104 can move radially relative to each other about the Oldham features 108/ Oldham receiving features 112 in relation to radial movement of the inner camshaft 18 relative to the outer camshaft 20. In this implementation, the first VCT device 102 is an electrically-actuated camshaft phaser while the second VCT device 104 is a hydraulically-actuated camshaft phaser. However, it should be understood that in other implementations two electrically-actuated VCT devices or two hydraulically-actuated VCT devices can be used. The inner camshaft 18 and the outer camshaft 20 can be moved angularly with respect to each other. Concentric camshafts are known by those skilled in the art, an example of which is shown in. FIG. 1 of U.S. Pat. No. 8,186,319 and described in column 6, lines 10-53; the contents of that portion of U.S. Pat. No. 8,186,319 are incorporated by reference.

The first VCT device 102 includes a mechanical gearbox linked to the electric motor 36 that can vary the angular position of the inner camshaft 18 relative to the crankshaft 12. It should be appreciated that the electrically-actuated VCT device can be implemented in a variety of different ways. For example, the first VCT device 102 can use a planetary gear assembly 122 engaging a plurality of ring gears that each have radially-inwardly facing gear teeth. An example of this type of camshaft phasing device is described in U.S. Patent Application Publication No. 2017/0248045 the entirety of which is incorporated by reference. The first VCT device 102 can include a housing 124 having a first ring gear 128, a cam ring gear 126 having a second ring gear 134, a sun gear 130, the planetary gear assembly 122, and an inner retaining plate 136.

The first ring gear 128 includes a plurality of radially-inwardly-facing gear teeth. The planetary gear assembly 122 includes the sun gear 130 that receives rotational input from the electric motor 36. The planetary gear assembly 122 includes a plurality of planetary gears 138 that engage the first ring gear 128 and a second ring gear 134. The, second ring gear 134 can include a plurality of radially-inwardly-facing gear teeth. However, the second ring gear 134 can have a different number of gear teeth relative to the first ring gear 128. In one implementation, the difference in the number of gear teeth can equal the number of planetary gears 138. For example, if the gearbox includes three planetary gears 138, the second ring gear 134 can have three fewer teeth, than the first ring gear 128. As a result, when the output shaft of the electric motor 36 rotates at an increased or decreased angular velocity relative to the VCT assembly 100, the second ring gear 134 is angularly displaced relative to the first ring gear 128.

When the output shaft of the electric motor 36, coupled to the sun gear 130, rotates the planetary gearbox 122 at the same angular velocity at which the VCT assembly 10 and the ring gears 128, 134 rotate, the angular position of the inner camshaft 18 will be maintained relative to the crankshaft 12. And when the output shaft of the electric motor 36 rotates at an angular velocity that is higher or lower than the VCT assembly 10, the planetary gear assembly 122 can angularly displace the second ring gear 134 relative to the first ring gear 128 thereby angularly displacing the inner camshaft 18 relative to the crankshaft 12. The angular displacement of the inner camshaft 18 relative to the crankshaft 12 can advance or retard the timing of the inner camshaft 18 relative to the crankshaft 12. The inner camshaft 18 can be phase shifted over a range of angular positions that are defined by stops 140 limiting changes in angular position of the inner camshaft 18 between a fully retarded position and a fully advanced position. In some implementations, this range can be as large as 140 crank degrees or 70 degrees at the phaser.

The housing 124, the first ring gear 128, the second ring gear 134, and the planetary gearbox 122 can be constrained axially between the inner retaining plate 136 and the outer retaining plate 129. The inner retaining plate 136 can include a plurality of Oldham receiving features 112 that engage the Oldham features 108 of the coupling plate 106 and permit the radial displacement of the first VCT device 102 relative to the second VCT device 104 about the axis (x). The Oldham receiving features 112 can be implemented in a variety of ways. For example, the Oldham receiving features 112 can have a defined width and extend radially outwardly beyond an outer diameter 194 of the inner plate 136 away from the axis (x). The Oldham receiving features 112 can be coplanar with the inner plate 136 and shaped to engage similarly-shaped Oldham features 108 formed in the inner diameter 114 of the coupling plate 106. In this implementation, the coupling plate 106 can have an outer diameter 116 and an inner diameter 114. The Oldham features 108 in the inner diameter 114 can have a defined width and extend radially outwardly from the inner diameter 114 away from the axis x. The Oldham receiving features 112 can be shaped so that a width of the receiving features 112 is less than the Oldham features 108 so that relative movement exists between the Oldham features 108 and the Oldham receiving features 112 within a plane defined by inner plate 136.

Each element of the first VCT device 102 can include a central bore 146 that permits a central bolt 110 to pass through and engage with a threaded receiving feature 150 of the inner camshaft 18. The central bolt 110 can rigidly connect the first VCT device 102 to the inner camshaft 18 so that the rotational energy communicated from the crankshaft 12 to the VCT assembly 100 can be communicated to the inner camshaft 18 through the VCT assembly 100. The central bolt 110 prevents radial or angular displacement between an output of the first VCT device 102 and the inner camshaft 18. It should be understood that this is one particular implementation of a cam phaser actuated by an electric motor and that other cam phaser designs including electric motors could also be successfully used.

The second VCT device 104 can include a rotor 152, coupled with the outer camshaft 20, that can be angularly displaced relative to a stator 154 that includes or is rigidly coupled with an inner plate 156 that incorporates the camshaft sprocket 22. Angularly displacing the rotor 152 relative to the stator 154 can vary the angular position of the outer camshaft 20 relative to the crankshaft 12. It should be appreciated that the hydraulically-actuated second VCT device 104 can be implemented in a variety of different ways. However, in this implementation, the second VCT device 104 can include the inner plate 156 with the sprocket 22, the rotor 152, the stator 154, an outer plate 158, a biasing element 160, and a trigger wheel 162. The rotor 152 can be coupled with the outer camshaft 20 such that the rotor 152 and the outer camshaft 20 are angularly fixed relative to each other and the rotor 152 does not move radially or angularly with respect to the outer camshaft 20. The inner plate 156, the stator 154, and the outer plate 158 can be positioned axially relative to each other and compressed to radially and axially constrain the rotor 152 and at least partially define one or more fluid chambers 164 used with the rotor 152. Together, the inner plate 156, the stator 154, and the outer plate 158 can form a housing assembly of the second VET device 104. One or more fasteners 166 can extend through the outer plate 158 and the stator 154 engaging threaded receivers 168 in the inner plate 156 to compress these elements.

The outer plate 158 can include Oldham receiving features 112 that engage Oldham features 108 of the coupling plate 106 to permit the radial movement of the first VCT device 102 relative to the second VCT device 104. The Oldham receiving features 112 can extend axially along, or parallel to, the x axis away from the outer plate 158 and toward the coupling plate 106. Oldham features 108 formed in the outer diameter 116 of the coupling plate 106 can extend radially inwardly toward the x axis and receive the Oldham receiving features 112 from the outer plate 158. The Oldham receiving features 112 can have a defined width that is less than the width of the Oldham features 108 of the coupling plate 106 permitting radial movement of the second VCT device 104 relative to the coupling plate 106 and/or the first VCT device 102.

The rotor 152 includes one or more vanes 170 that extend radially outwardly from a hub 172 into fluid chamber(s) 164 of the stator 154. The stator 154 includes fluid chambers 164 within which the vanes 170 move angularly with respect to the stator 154 about the axis of camshaft rotation (x). Pressurized fluid can be supplied from a fluid source through a plurality of fluid supply lines (not shown) to the fluid chambers 164. In this implementation, the fluid supply lines may pass through the inner camshaft 18 and communicate pressurized fluid, such as engine oil, to the fluid chambers 164. To move the rotor 152 relative to the stator 154 in one angular direction, the pressurized fluid can be directed through a first fluid supply line to one side of the vane(s) 170; and to move the rotor 152 relative to the stator 154 in another angular direction, the pressurized fluid can he directed through a second fluid supply line to an opposite side of the vane(s) 170. A range of authority can be defined by the angular distance the fluid chambers 164 permit the rotor 152 to move relative to the stator 154.

The biasing element 160 can be used with the second VCT device 104. In this implementation, the second VCT device 104 can be a camshaft torque actuated (CTA) design that uses the energy created by the rotation of the outer camshaft 20 to change the angular position of the outer camshaft 20 relative to the crankshaft 12. The biasing element 160 can fit in a space axially positioned between the outer plate 158 and the trigger wheel 162 that is rigidly affixed to the outer plate 158. One end of the biasing element 160 can engage the rotor 152 while another end of the biasing element 160 can engage the trigger wheel 162. The biasing element 160 can counteract a torsional bias toward retarding timing created by the rotation of the outer camshaft 20 on the rotor 152.

The trigger wheel 162 can be formed from a plate 174 that extends radially-outwardly away from the axis of camshaft rotation (x) and an annular portion 176 that extends axially along the axis of camshaft rotation (x). The plate 174 can include one or more apertures 178 through which fasteners pass and engage the outer plate 158 to rigidly affix the trigger wheel 162 to an assembly including the stator 154.

The Oldham features 108 of the coupling plate 106 can be received by the Oldham receiving features 112 and permit the coupling plate 106 to slide radially inwardly and radially outwardly relative to the axis of camshaft rotation (x) as the VCT assembly 10 rotates. The Oldham features 108 on the inner diameter 114 of the coupling plate 120 can be positioned 180 degrees from each other and 90 degrees from the Oldham features 108 on the outer diameter 116 of the coupling plate 106.

Figure 12:
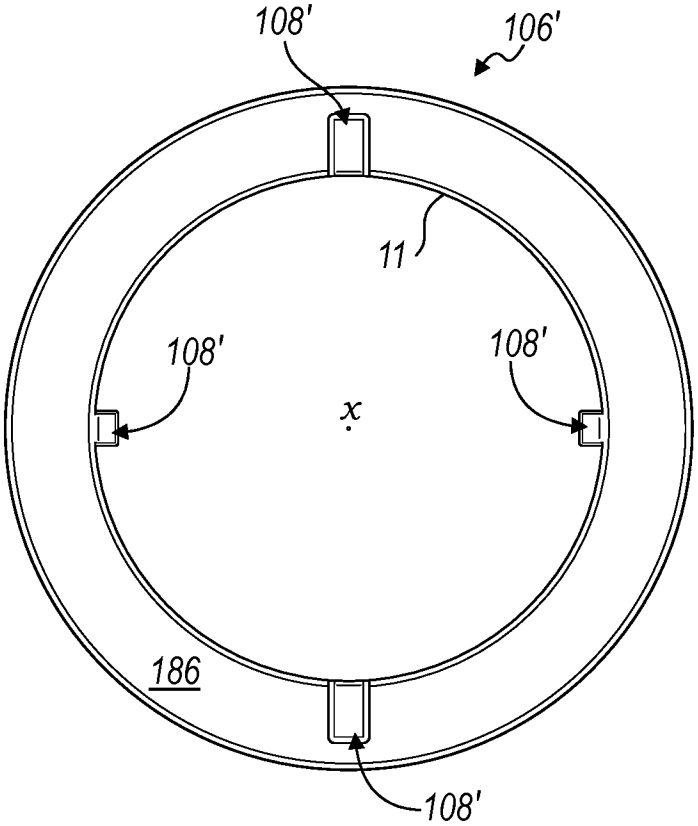
FIG. 12 is another profile view of another implementation of a coupling plate used in a VCT assembly.
Figure 11:
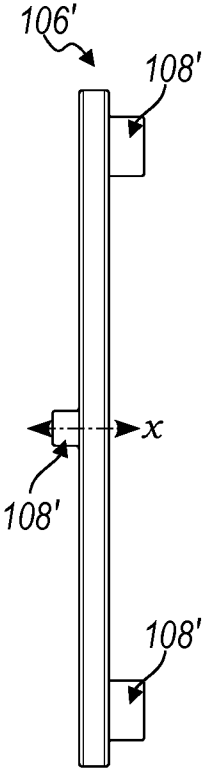
FIG. 11 is another profile view of another implementation of a coupling plate used in a VCT assembly.
Figure 10:
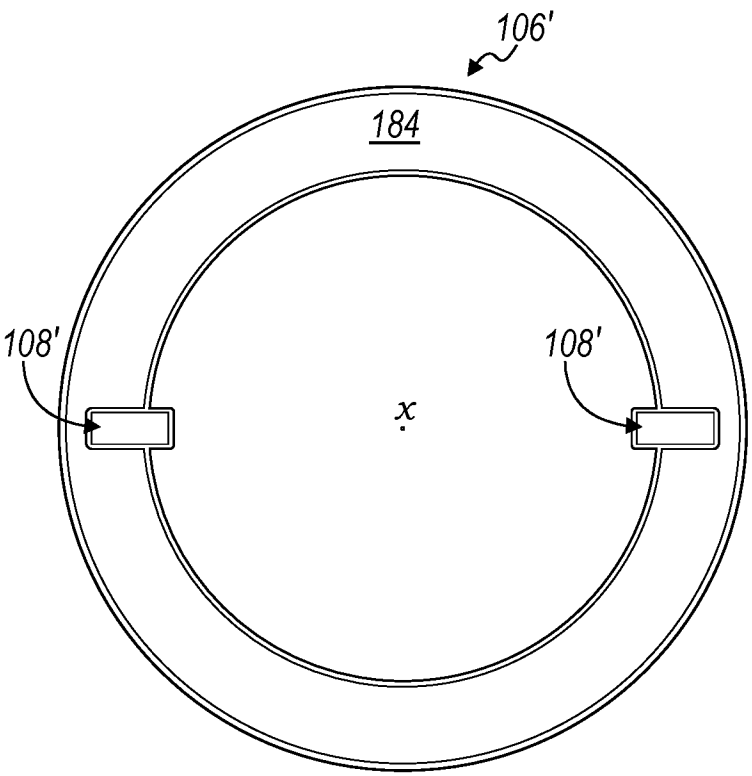
FIG. 10 is a profile view of another implementation of a coupling plate used in a VCT assembly.
Figure 13:
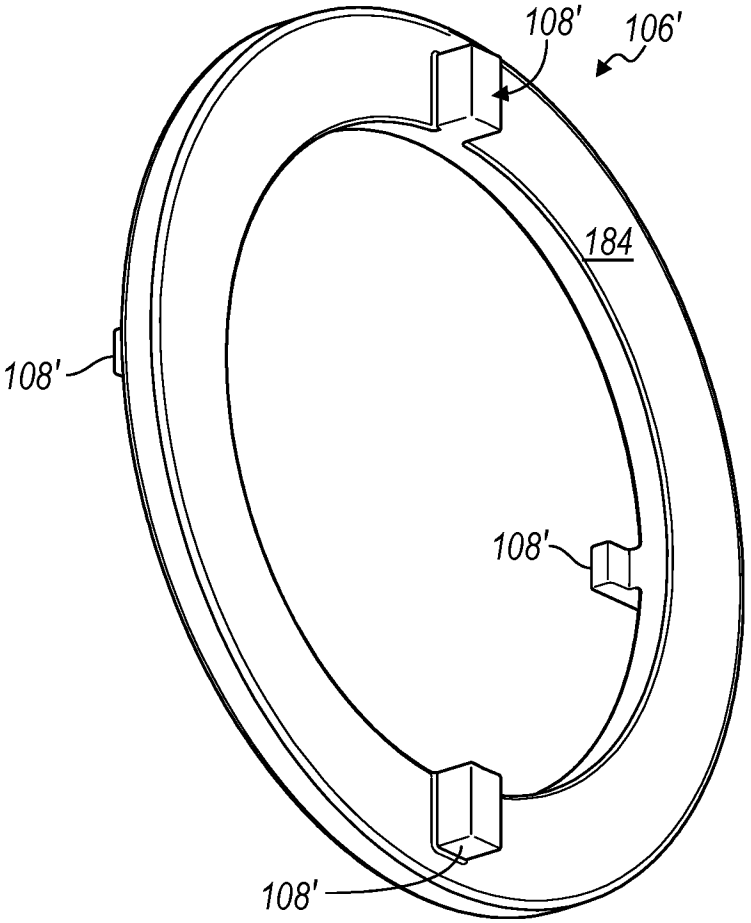
FIG. 13 is an isometric view of another implementation of a coupling plate used in a VCT assembly.

Other implementations of the coupling plate are possible. For example, another implementation of a coupling plate 106' is shown in FIGS. 10-12 that, can include a first radial surface 184 and a second radial surface 186 on the opposite side of the first radial surface 184. Oldham features 108' can be positioned on the first radial surface 184 and the second radial surface 186 that engage Oldham receiving features on the first VCT device and the second VCT device. The Oldham features 108' can extend away from the first radial surface 184 along the x axis in one direction and the other Oldham features 108' can extend away from the second radial surface 186 along the x-axis in another direction. The Oldham features 108' can have a variety of cross-sectional shapes. In this implementation, the Oldham features have a rectangular cross-sectional shape but it is possible for different shapes, such as Oldham features that have a square cross-sectional shape. Other implementations are possible. For instance, the Oldham features can be cylindrical such as could be implemented using solid pins having a circular cross section. The Oldham features 108' are positioned on the radial surfaces 184, 186 of the coupling plate 108' at a point that is radially outwardly from the axis (x) of camshaft rotation and sized so that they engage Oldham receiving features of the first VCT device and the second VCT device. If the first VCT device is misaligned with respect to the camshafts and/or the second VCT device the Oldham features 108' can slide radially inwardly and radially outwardly with respect to each other and the x axis as the VCT assembly rotates. The Oldham features 108' also allow for axial relative movement, of the camshafts 18, 20 relative to each other.

The system 10 can include a system processing device 56 as another, separate microprocessor/microcontroller, such as an electronic control unit (ECU), that receives an electric motor position signal from the electric motor controller as well as output from the crank position sensor 34. The system processing device 56 can use this information to actuate the VCT device 102, the second VCT device 104, or both, as disclosed herein. The system processing device 56 can be any type of device capable of processing electronic instructions including microprocessors, microcontrollers, host processors, controllers, vehicle communication processors, and application specific integrated circuits (ASICs). It can be a dedicated processor used only to carry out the described functionality of the VCT devices or can be shared with other systems of an internal combustion engine or vehicle. The system processing device 56 executes various types of digitally-stored instructions, such as software or firmware programs stored in memory. Communications between the sensor 34, the electric motor controller, and the system processing device 56 can be carried out over a communications bus 58, such as those that are implemented using a controller area network (CAN) protocol. However, it should be appreciated that other implementations are possible in which at least some of these elements could be implemented together on a printed circuit board.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A variable camshaft timing (VCT) assembly for changing an angular position of concentric camshafts relative to a crankshaft, comprising:

a coupling plate, including a first plurality of Oldham features configured to engage a first plurality of Oldham receiving features carried by a first VCT device and a second plurality of Oldham features configured to engage a second plurality of Oldham receiving features carried by a second VCT device, wherein the coupling plate is positioned axially between the first VCT device and the second VCT device permitting the first VCT device and the second VCT device to move radially outwardly and inwardly relative to an axis of camshaft, rotation.

2. The VCT assembly recited in claim 1, wherein the first. VCT device is electrically-actuated and the second VCT device is hydraulically-actuated.

3. The VCT assembly recited in claim 2, further comprising a first VCT device that is coupled with an inner camshaft and a second VCT device that is coupled with an outer camshaft.

4. The VCT assembly recited in claim 2, wherein the first VCT device includes an inner plate that carries the first plurality of Oldham receiving features.

5. The VCT assembly recited in claim 2, wherein the second VCT device includes a housing that carries the second plurality of Oldham receiving features.

6. The VCT assembly recited in claim 1, wherein the coupling plate has an inner diameter and an outer diameter, wherein the first plurality of Oldham features is formed along the inner diameter and the second plurality of Oldham features is formed along the outer diameter.

7. The VCT assembly recited in claim 1, wherein the coupling plate comprises a first radial surface having the first plurality of Oldham features and a second radial surface having the second plurality of Oldham features on the opposite side of the first radial surface.

8. A variable camshaft timing (VCT) assembly for changing an angular position of concentric camshafts relative to a crankshaft, comprising:

a first VCT device, having a first plurality of Oldham receiving features, configured to rigidly couple with a first concentric camshaft:

a second VCT device, having a second plurality of Oldham receiving features configured to rigidly couple with a second concentric camshaft: and a coupling plate, including a first plurality of Oldham features that engage the first plurality of Oldham receiving features and a second plurality of Oldham features that engage the second plurality of Oldham receiving features, positioned axially between the first VCT device and the second VCT device, wherein the first VCT device and the second VCT device move radially outwardly and inwardly relative to an axis of camshaft rotation.

9. The VCT assembly recited in claim 8, wherein the first VCT device is electrically-actuated and the second VCT device is hydraulically-actuated.

10. The VCT assembly recited in claim 8, wherein the first plurality of Oldham receiving features comprises projections or recesses and the first plurality of Oldham features comprises the other of projections or recesses, and the second plurality of Oldham receiving features comprises projections or recesses and the second plurality of Oldham features comprises the other of projections or recesses.

11. The VCT assembly recited in claim 8, wherein the first VCT device includes an inner plate that carries the first plurality of Oldham receiving features.

12. The VCT assembly recited in claim 8, wherein the second VCT device includes an outer plate that carries the second plurality of Oldham receiving features.

13. The VCT assembly recited in claim 8, wherein the coupling plate has an inner diameter and an outer diameter, wherein the first plurality of Oldham features is formed along the inner diameter and the second plurality of Oldham features is formed along the outer diameter.

14. The VCT assembly recited in claim 8, wherein the>coupling plate comprises a first radial surface having the first plurality of Oldham features and a second radial surface having the second plurality of Oldham features on the opposite side of the first radial surface.

15. A variable camshaft timing (VCT) assembly for changing an angular position of concentric camshafts relative to a crankshaft, comprising:

a first VCT device, having a first plurality of Oldham receiving features that extend radially-outwardly away from an axis of camshaft, rotation, configured to rigidly couple with a first concentric camshaft;

a second VCT device, having a second plurality of Oldham receiving features that extend at, least partially in a direction parallel to the axis of camshaft rotation, configured to rigidly couple with a second concentric camshaft; and a coupling plate, including a first plurality of Oldham features formed in an inner diameter that engage the first plurality of Oldham, receiving features, and a second plurality of Oldham features formed in an outer diameter that engage the second plurality of Oldham receiving features, the coupling plate being positioned axially between the first VCT device and the second VCT device, wherein the first VCT device and the second. VCT device are moveable radially outwardly and inwardly relative to an axis of camshaft rotation via, the first and second plurality of Oldham receiving features and the first and second plurality of Oldham features.

16. The VCT assembly recited in claim 15, wherein the first VCT device is electrically-actuated and the second VCT device is hydraulically-actuated.

17. The VCT assembly recited in claim 15, wherein the first VCT device is coupled with an inner camshaft, and the second VCT device is coupled with an outer camshaft.

18. The VCT assembly recited in claim 15, wherein the first VCT device includes an inner plate that carries the first plurality of Oldham receiving features.

19. The VCT assembly recited in claim 15, wherein the second VCT device includes a housing that carries the second plurality of Oldham receiving features.

* * * * *